US012178241B2

(12) United States Patent
Lomas et al.

(10) Patent No.: US 12,178,241 B2
(45) Date of Patent: Dec. 31, 2024

(54) CONSUMABLE FOR A SMOKING SUBSTITUTE DEVICE

(71) Applicant: Imperial Tobacco Limited, Bristol (GB)

(72) Inventors: Pete Lomas, Liverpool (GB); Chris Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 982 days.

(21) Appl. No.: 16/951,033

(22) Filed: Nov. 18, 2020

(65) Prior Publication Data

US 2021/0068458 A1 Mar. 11, 2021

Related U.S. Application Data

(63) Continuation of application No. PCT/EP2019/062804, filed on May 17, 2019.

(30) Foreign Application Priority Data

May 18, 2018 (GB) ..... 1808108

(51) Int. Cl.
*A24F 40/42* (2020.01)
*A24D 3/17* (2020.01)
(Continued)

(52) U.S. Cl.
CPC ..... *A24D 3/17* (2020.01); *A24F 40/42* (2020.01); *A24F 40/46* (2020.01); *A24F 40/48* (2020.01); *A24F 40/485* (2020.01); *A24F 40/10* (2020.01)

(58) Field of Classification Search
CPC ..... A24F 40/00; A24F 40/10; A24F 40/40; A24F 40/42; A24F 40/46; A24F 40/48; A24F 40/485
See application file for complete search history.

(56) References Cited

U.S. PATENT DOCUMENTS

2013/0306065 A1* 11/2013 Thorens ..... A24F 40/40 128/202.21
2015/0034103 A1* 2/2015 Hon ..... A24F 40/44 131/328

(Continued)

FOREIGN PATENT DOCUMENTS

CN 105942582 A 9/2016
CN 205912903 U 2/2017

(Continued)

OTHER PUBLICATIONS

WO-2016208759-A1 (Machine Translation) [online], [retrieved on Sep. 27, 2023], retrieved from Espacenet (https://worldwide.espacenet.com/) (Year: 2016).*

(Continued)

*Primary Examiner* — Philip Y Louie
*Assistant Examiner* — Yana B Krinker
(74) *Attorney, Agent, or Firm* — DUNLAP CODDING, P.C.

(57) ABSTRACT

A consumable for a smoking substitute device, and a smoking substitute device including the consumable. The consumable comprising: a tank, for storing vapourisable liquid; a heater assembly, the heater assembly having an inlet and two or more outlets; and a connector, which is connected to the heater assembly, and which provides at least two airflow paths, each extending from a respective outlet of the heater assembly to an inlet of an airway tube. Each airflow path has a cross-section, located proximal to the respective outlet of the heater assembly, and a second cross-section, located proximal to the airway tube, and wherein the first cross-section is larger than the second cross-section.

19 Claims, 5 Drawing Sheets

(51) Int. Cl.

| | |
|---|---|
| ***A24F 40/46*** | (2020.01) |
| ***A24F 40/48*** | (2020.01) |
| ***A24F 40/485*** | (2020.01) |
| *A24F 40/10* | (2020.01) |

(56) References Cited

U.S. PATENT DOCUMENTS

| | | | | |
|---|---|---|---|---|
| 2016/0270442 | A1* | 9/2016 | Liu | A24F 40/485 |
| 2017/0119055 | A1 | 5/2017 | Liu | |
| 2017/0258134 | A1 | 9/2017 | Kane | |
| 2017/0280774 | A1* | 10/2017 | Force | A24F 40/42 |

FOREIGN PATENT DOCUMENTS

| | | | | |
|---|---|---|---|---|
| EP | 2 319 334 | A1 | 5/2011 | |
| EP | 2 460 422 | A1 | 6/2012 | |
| EP | 2 460 424 | A1 | 6/2012 | |
| EP | 2984952 | A1 | 2/2016 | |
| EP | 3315036 | A1 | 5/2018 | |
| WO | WO-2016208759 | A1 * | 12/2016 | A24F 40/46 |

OTHER PUBLICATIONS

UKIPO Search Report (GB1808108.3), dated Nov. 9, 2018, 6 pages.
International Search Report, mailed Aug. 7, 2019, in PCT/EP2019/062804, filed May 17, 2019.
Written Opinion of the International Searching Authority, mailed Aug. 7, 2019, in PCT/EP2019/062804, filed May 17, 2019.

* cited by examiner

CONSUMABLE FOR A SMOKING SUBSTITUTE DEVICE

CROSS-REFERENCE TO RELATED APPLICATIONS/INCORPORATION BY REFERENCE STATEMENT

The present patent application is a continuation of International Application No. PCT/EP2019/062804, filed May 17, 2019; which claims priority to the patent application identified by GB Serial No. GB 1808108.3, filed on May 18, 2018. The entire contents of each of the above-referenced patent(s)/patent application(s) are hereby expressly incorporated by reference herein.

FIELD OF THE INVENTION

The present invention relates to smoking substitute devices, and particularly, although not exclusively, to providing a consumable for a smoking substitute device including a tortuous or convoluted airway path through the consumable.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices, which may also be known as electronic nicotine delivery systems, may comprise electronic systems that permit a user to simulate the act of smoking by producing an aerosol, also referred to as a "vapour", which is drawn into the lungs through the mouth (inhaled) and then exhaled. The inhaled aerosol typically bears nicotine and/or flavourings without, or with fewer of, the odour and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilising a different smoking substitute approach. A smoking substitute approach corresponds to the manner in which the substitute system operates for a user.

One approach for a smoking substitute device is the so-called "vaping" approach, in which a vapourisable liquid, typically referred to (and referred to herein) as "e-liquid", is heated by a heating device to produce an aerosol vapour which is inhaled by a user. An e-liquid typically includes a base liquid as well as nicotine and/or flavourings. The resulting vapour therefore typically contains nicotine and/or flavourings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapour") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapour which is inhaled by a user through the mouthpiece.

Another example vaping smoking substitute device is the blu PRO™ e-cigarette. The blu PRO™ e-cigarette is an open system device which includes a main body, a (refillable) tank, and a mouthpiece. The main body and tank are physically and electrically coupled together by screwing one to the other. The mouthpiece and refillable tank are physically coupled together by screwing one into the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapour which is inhaled by a user through the mouthpiece.

Another approach for a smoking substitute device is the so-called "heat not burn" ("HNB") approach in which tobacco (rather than e-liquid) is heated or warmed to release vapour. The tobacco may be leaf tobacco or reconstituted tobacco. The vapour may contain nicotine and/or flavourings. In the HNB approach the intention is that the tobacco is heated but not burned, i.e. does not undergo combustion.

A typical HNB smoking substitute device may include a main body and a consumable. The consumable may include the tobacco material. The main body and consumable may be configured to be physically coupled together. In use, heat may be imparted to the tobacco material by a heating device that is typically located in the main body, wherein airflow through the tobacco material causes moisture in the tobacco material to be released as vapour. A vapour may be formed from a carrier in the tobacco material (this carrier may for example include propylene glycol and/or vegetable glycerin) and additionally volatile compounds released from the tobacco. The released vapour may be entrained in the airflow drawn through the tobacco.

As the vapour passes through the smoking substitute device (entrained in the airflow) from an inlet to a mouthpiece (outlet), the vapour cools and condenses to form an aerosol (also referred to as a vapour) for inhalation by the user. The aerosol will normally contain the volatile compounds.

In HNB smoking substitute devices, heating as opposed to burning the tobacco material is believed to cause fewer, or smaller quantities, of the more harmful compounds ordinarily produced during smoking. Consequently, the HNB approach may reduce the odour and/or health risks that can arise through the burning, combustion and pyrolytic degradation of tobacco.

An example of the HNB approach is the IQOS® smoking substitute device from Philip Morris Ltd. The IQOS® smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapour and flavourings which may be drawn through the mouthpiece by the user through inhalation.

A second example of the HNB approach is the device known as "Glo"® from British American Tobacco p.l.c. Glo® comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapour and flavourings which may be drawn through the consumable by the user through inhalation. The tobacco, when heated by the heating device, is configured to produce vapour when heated rather than when burned (as in a smoking apparatus, e.g. a cigarette). The tobacco may contain high levels of aerosol formers (carrier), such as vegetable glycerine ("VG") or propylene glycol ("PG").

The present inventor(s) have observed that in previous devices, droplets of unvapourised liquid are drawn into a mouthpiece of the consumable and may enter the mouth of, be ingested by, or be inhaled by a user of the device.

The present invention has been devised in light of the above considerations.

SUMMARY

At its broadest, aspects of the invention are concerned with a consumable for a smoking substitute device, the consumable comprising: a tank, for storing vapourisable liquid; a heater assembly, the heater assembly having an inlet and two or more outlets; and a connector, which is connected to the heater assembly, and which provides at least two airflow paths, each extending from a respective outlet of the heater assembly to an inlet of an airway tube.

In a first aspect, the invention provides a consumable for a smoking substitute device, the consumable comprising: a tank, for storing vapourisable liquid; a heater assembly, the heater assembly having an inlet and two or more outlets; and a connector, which is connected to the heater assembly, and which provides at least two airflow paths, each extending from a respective outlet of the heater assembly to an inlet of an airway tube; wherein each airflow path has a cross-section, located proximal to the respective outlet of the heater assembly, and a second cross-section, located proximal to the airway tube, and wherein the first cross-section is larger than the second cross-section.

Advantageously, such a connector reduces the likelihood of unvapourised droplets liquid being drawn in to the mouthpiece. The reduction in cross-section allows the meniscus effect of the liquid to retard or halt the flow of liquid through the connector, and so help prevent the unvapourised liquid from entering the user's mouth (whereupon it may be ingested or inhaled).

In a second aspect, the invention provides a smoking substitute device including the consumable as set out with respect to the first aspect.

Optional features of the invention will now be set out. These are applicable singly or in any combination with any aspect of the invention.

Cross-section may referred to cross-sectional area and/or cross-sectional diameter (e.g. the shortest distance joining two opposing sides of the airflow path). The heater assembly may be a coil and wick heater assembly. The connector may be configured such that there is no direct line of sight between the heater assembly and the airway tube.

The consumable may include one or more fixed baffles, which at least partially defines the airflow paths. The baffle may be provided by a surface of the connector, which may be proximal to the heater assembly. Further baffles may be introduced into alternative parts of the consumable, for example in the airway tube.

Each airflow path may include at least two turns.

The heater assembly may define at least two airflow paths, each of which may start from the inlet and extend to a respective one of said outlets.

Each airflow path through the connector may narrow in a direction from the heater assembly to the airway tube.

The consumable may further comprise a mouthpiece connected to the air way tube at a point distal to the connector.

The airflow path through the connector may be tortuous.

The connector may be at least partially formed by a seal, sealing the heater assembly to the airway tube. The seal may be such that vapourisable liquid contained within the tank cannot seep into airway tube. The seal is such that air may flow from an interior portion of the heater assembly into an interior portion of the airway tube. The connector or seal may be at least partially formed of silicone.

A portion of the airway tube proximal to the heater assembly may have a cross-sectional area of more than 5 $mm^2$.

The airway tube may have a cross-sectional area of no more than 10 $mm^2$.

The airway tube may have an internal diameter of more than 2.5 mm.

The airway tube may have an internal diameter of no more than 4 mm.

The cross-sectional area of the airway tube may be substantially constant along its length.

The internal diameter of the airway tube may be at least 20% of a width of the tank.

The tank may have a width, as measured in the same direction as the internal diameter of the airway tube, of at least 10 mm and no more than 20 mm.

The consumable may further comprise a filter, disposed between the tank and an outlet of the mouthpiece, which is configured to be impermeable to unvapourised liquid and permeable to vapourised liquid.

The filter may be positioned in or adjacent to the mouthpiece.

The consumable may further include an air inlet, disposed at an opposite end of the consumable to the mouthpiece, and the air inlet, heater assembly, and mouthpiece may define a path for airflow through the consumable in that order.

The filter may be formed from a fabric, so as to be permeable to vapourised liquid but impermeable to unvapourised liquid.

The filter may be formed from a mesh so as to be permeable to vapourised liquid but impermeable to unvapourised liquid.

The filter may be a gas-permeable and liquid-impermeable membrane.

BRIEF DESCRIPTION OF THE DRAWINGS

Embodiments of the invention will now be described by way of example with reference to the accompanying drawings in which:

FIG. 1(*b*) shows the main body of the smoking substitute device of FIG. 1(*a*) without the consumable;

FIG. 1(*c*) shows the consumable of the smoking substitute device of FIG. 1(*a*) without the main body;

FIG. 2(*b*) is a schematic view of the consumable of the smoking substitute device of FIG. 1(*b*);

DETAILED DESCRIPTION AND FURTHER OPTIONAL FEATURES

Aspects and embodiments of the present invention will now be discussed with reference to the accompanying figures. Further aspects and embodiments will be apparent to those skilled in the art. All documents mentioned in this text are incorporated herein by reference FIG. 1(*a*) shows an example smoking substitute device 110. In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

Figure 1A:
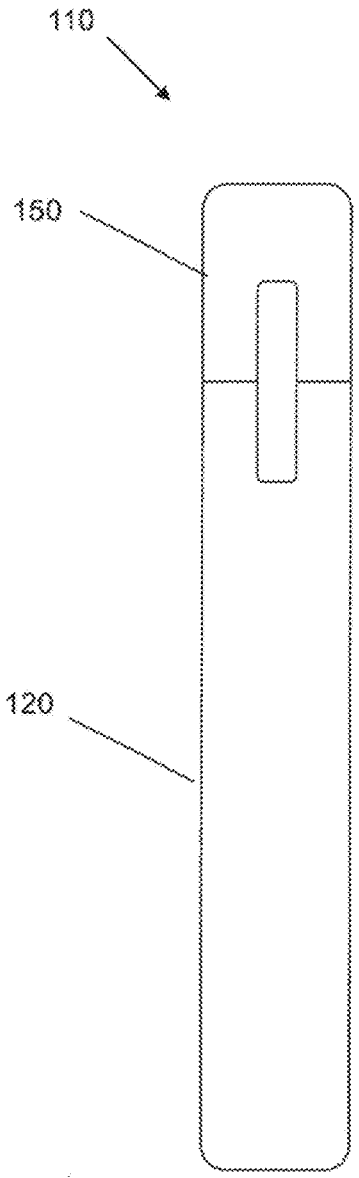
FIG. 1(*a*) shows an example smoking substitute device.
Figure 1B:
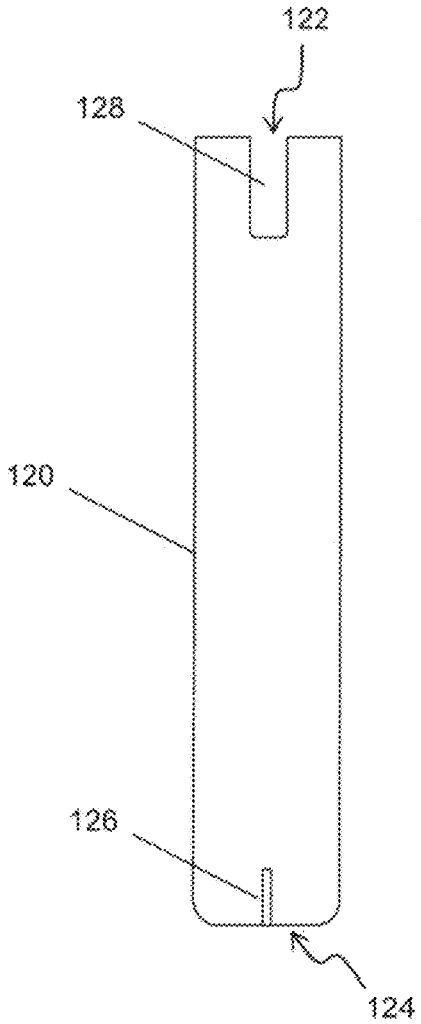
Figure 1C:
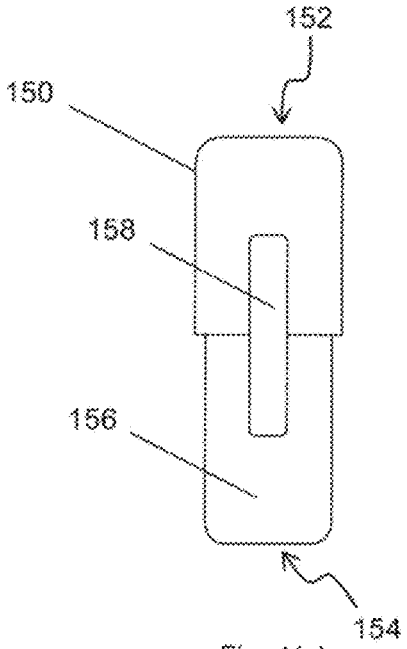

FIG. 1(*a*) shows the smoking substitute device 110 with the main body 120 physically coupled to the consumable 150.

FIG. 1(*b*) shows the main body 120 of the smoking substitute device 110 without the consumable 150.

FIG. 1(*c*) shows the consumable 150 of the smoking substitute device 110 without the main body 120.

The main body 120 and the consumable 150 are configured to be physically coupled together, in this example by pushing the consumable 150 into an aperture in a top end 122 of the main body 120. In other examples, the main body 120 and the consumable could be physically coupled together by screwing one onto the other, or through a bayonet fitting, for example. An optional light 126, e.g. an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIGS. 1[*a*], 1[*b*], 1[*c*]) so that air can be drawn into the smoking substitute device 110 when a user inhales through the mouthpiece.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

The tank 156 may be referred to as a "clearomizer" if it includes a window 158, or a "cartomizer" if it does not.

The consumable 150 may identify itself to the main body 120, via an electrical interface, RFID chip, or barcode.

Figure 2A:
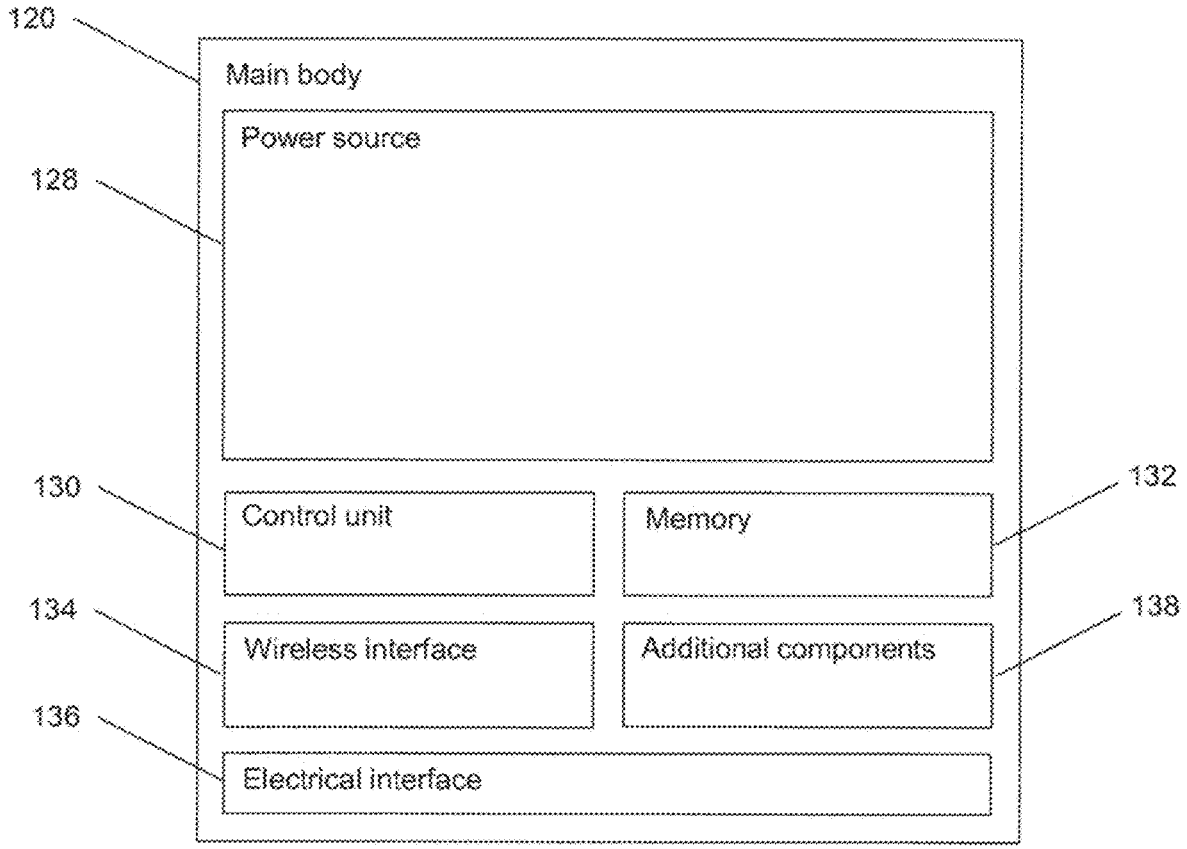
FIG. 2(*a*) is a schematic view of the main body of the smoking substitute device of FIG. 1(*a*)
Figure 2B:
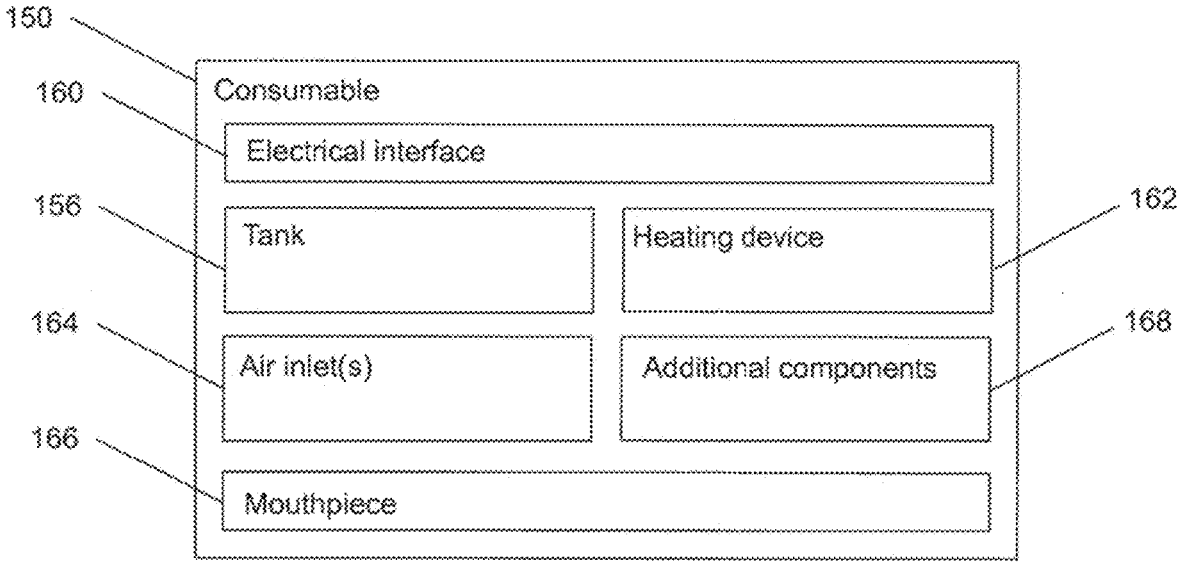

FIG. 2(*a*) is a schematic view of the main body 120 of the smoking substitute device 110.

FIG. 2(*b*) is a schematic view of the consumable 150 of the smoking substitute device 110.

As shown in FIG. 2(*a*), the main body 120 includes a power source 140, a control unit 130, a memory 132, a wireless interface 134, an electrical interface 136, and, optionally, one or more additional components 138.

The power source 140 is preferably a battery, more preferably a rechargeable battery.

The control unit 130 may include a microprocessor, for example.

The memory 132 is preferably includes non-volatile memory. The memory may include instructions which, when implemented, cause the control unit 130 to perform certain tasks or steps of a method.

The wireless interface 134 is preferably configured to communicate wirelessly with the mobile device 2, e.g. via Bluetooth®. To this end, the wireless interface 134 could include a Bluetooth® antenna. Other wireless communication interfaces, e.g. WiFi®, are also possible. As discussed above, the wireless interface 134 may be configured to communicate wirelessly with the remote server 2.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 140 to (e.g. a heating device of) the consumable 150 when the smoking substitute device 110 is activated, e.g. via the electrical interface 160 of the consumable 150 (discussed below). When the main body 120 is not physically coupled to the consumable 150, the electrical interface may be configured to receive power from the charging station 6. The electrical interface 136 may also be used to identify the consumable 150 from a list of known consumables. For example, the consumable may be a particular flavour and/or have a certain concentration of nicotine. This can be identified to the control unit 130 of the main body 120 when the consumable is connected to the main body. Additionally, or alternatively, there may be a separate communication interface provided in the main body 120 and a corresponding communication interface in the consumable 150 such that, when connected, the consumable can identify itself to the main body 120.

The additional components 138 of the main body 120 may include the optional light 126 discussed above.

The additional components 138 of the main body 120 may, if the power source 140 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 140 is a rechargeable battery, include a battery charging control circuit, for controlling the charging of the rechargeable battery. However, a battery charging control circuit could equally be located in the charging station 6 (if present).

The additional components 138 of the main body 120 may include an airflow sensor for detecting airflow in the smoking substitute device 110, e.g. caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example). The airflow sensor can be used to determine, for example, how heavily a user draws on the mouthpiece or how many times a user draws on the mouthpiece in a particular time period.

The additional components 138 of the main body 120 may include an actuator, e.g. a button. The smoking substitute device 110 may be configured to be activated when the actuator is actuated. This provides an alternative to the airflow sensor noted, as a mechanism for activating the smoking substitute device 110.

As shown in FIG. 2(*b*), the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g. in the form of an electrical current) is able to be supplied from the power source 140 in the main body 120 to the heating device 162 in the consumable 150.

The heating device 162 is preferably configured to heat e-liquid contained in the tank 156, e.g. using electrical energy supplied from the power source 140. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapour.

The one or more air inlets 164 are preferably configured to allow air to be drawn into the smoking substitute device 110, when a user inhales through the mouthpiece 166.

In use, a user activates the smoking substitute device 110, e.g. through actuating an actuator included in the main body 120 or by inhaling through the mouthpiece 166 as described above. Upon activation, the control unit 130 may supply electrical energy from the power source 140 to the heating device 162 (via electrical interfaces 136, 166), which may cause the heating device 162 to heat e-liquid drawn from the tank 156 to produce a vapour which is inhaled by a user through the mouthpiece 166.

As an example of one of the one or more additional components 168, an interface for obtaining an identifier of the consumable may be provided. As discussed above, this interface may be, for example, an RFID reader, a barcode or QR code reader, or an electronic interface which is able to identify the consumable to the main body. The consumable may, therefore include any one or more of an RFID chip, a barcode or QR code, or memory within which is an identifier and which can be interrogated via the electronic interface in the main body.

Figure 3:
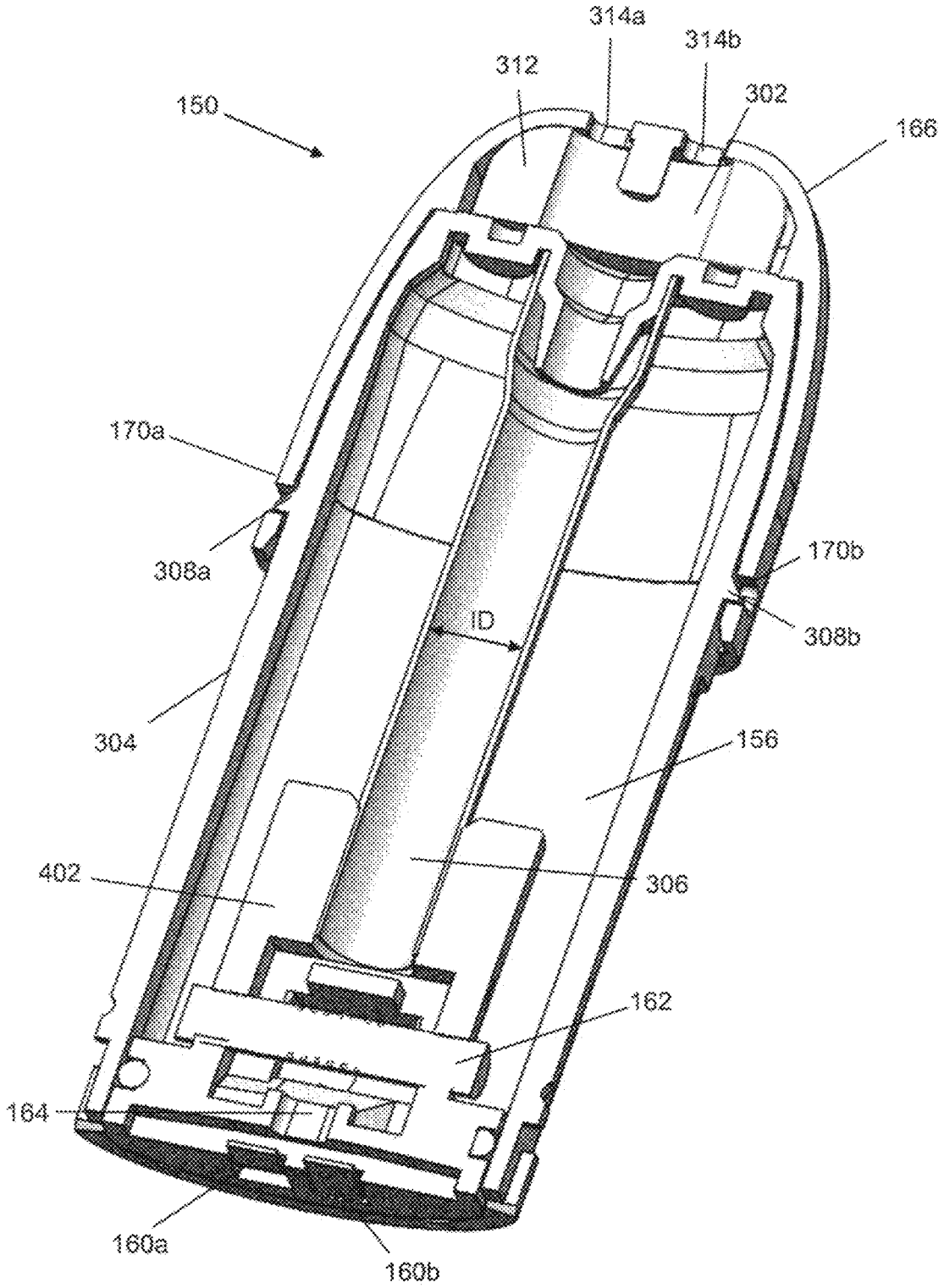
FIG. 3 is a perspective partial cross-sectional view of a consumable for the smoking substitute device.

Of course, a skilled reader would readily appreciate that the smoking substitute device 110 shown in FIGS. 2 and 3 shows just one example implementation of a smoking substitute device, and that other forms of smoking substitute device could be used.

By way of example, a HNB smoking substitute device including a main body and a consumable could be used, instead of the smoking substitute device 110. One such HNB smoking substitute device is the IQOS® smoking substitute device discussed above.

As another example, an open system vaping device which includes a main body, a refillable tank, and a mouthpiece could be used, instead of the smoking substitute device 110. One such open system vaping device is the blu PROT™ e-cigarette discussed above.

As another example, an entirely disposable (one use) smoking substitute device could be used as the smoking substitute device.

FIG. 3 shows a perspective cross-sectional view of a consumable 150 as discussed previously. Broadly, the consumable is formed of a tank 156 formed by tank housing 304, a heater assembly 162, an airway tube 306, and a mouthpiece 166. The consumable includes an air inlet 164, which allows air to flow into the heater assembly, through the airway tube 306, to the mouthpiece 166. The airway tube 306 is sealed to the heater assembly 162 via connector 402.

In this example, the heater assembly is a coil and wick assembly. As such, a coil is present within the heater assembly with a wick passing therethrough. The wick is then exposed to a liquid filled volume of the tank 156, so that vapourisable liquid contained therein is wicked into an interior of the heater assembly. Thus, in use, the coil is heated via an electrical current and vapourisable liquid within the wick is vapourised. This heating is generally triggered by the user drawing from the mouthpiece, causing an airflow past the coil.

The airway tube 306 in this example, which may be referred to as a chimney, has an internal diameter, ID, of around 3.5 mm. This gives a cross-sectional area of around 9.6 $mm^2$. Such a cross-sectional area has been found to limit the air velocity for any given flow rate, such that it is less likely that droplets of unvapoursed liquid will be drawn into the airway tube and through to the mouthpiece 166.

As can be seen in this example, the cross-sectional area of the airway tube is substantially constant along most or all of its length. There is a slight increase in the cross-sectional area towards an upper end of the airway tube, near to the mouthpiece 166. However the cross-sectional area at this point in the airway tube has a limited impact on the air velocity within the heater assembly 162.

Located, in this example within the mouthpiece 166, is a filter 302. The filter in this example is a fabric which is permeable to gas or vapourised liquid whilst impermeable to liquid or unvapourised liquid. The filter covers the mouthpiece airway tube 314*a* and 314*b*, so that liquid or unvapourised liquid cannot pass therethrough. The filter is generally tubular, so that it sits snugly within the mouthpiece 166. Whilst the filter in this example is within the mouthpiece, it will be appreciated that it could, instead, be located within the airway tube 306 or at any position between the heater assembly 162 and the mouthpiece outlets 314*a* 314*b*. The filter in this example is made from cotton or another fibre.

The mouthpiece in this example is a plastic moulding providing an outer casing and two apertures 170*a*, 170*b* for corresponding clips 308*a*, 308*b* of the tank 156. The mouthpiece outlets 314*a* and 314*b* are provided as apertures through the plastic moulding. The clips of the tank engage the corresponding apertures so to retain the mouthpiece adjacent to the tank. The interior of the mouthpiece 166 between the apertures 310*a* and 310*b* and mouthpiece outlets 314*a* 314*b* is generally defined as a mouthpiece chamber 312.

Figure 4:
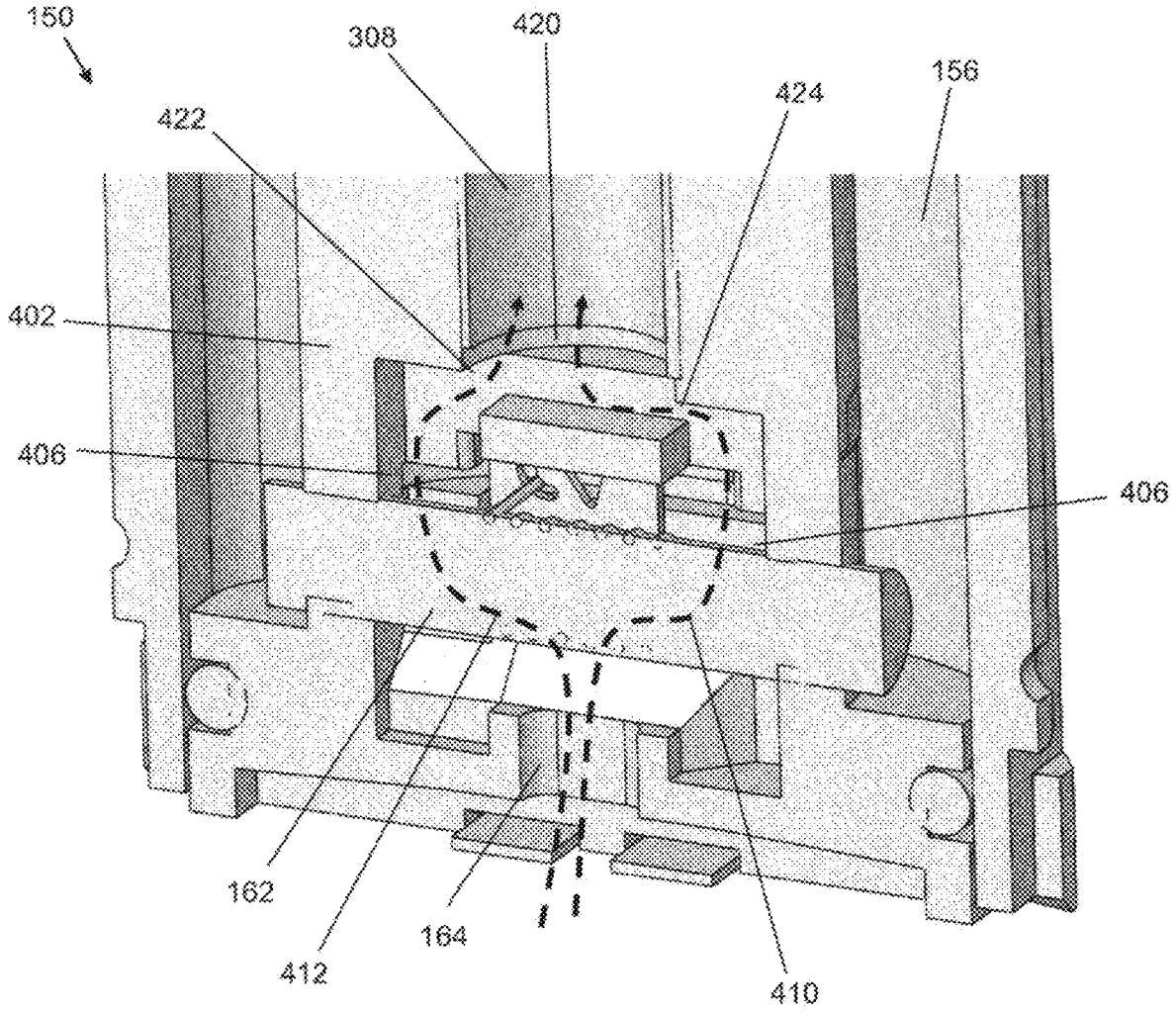
FIG. 4 is a perspective partial cross-sectional view of a lower portion of a consumable for the smoking substitute device.

FIG. 4 shows a perspective cross-sectional view of a lower portion of the consumable 150. The connector 402 is shown in greater detail, as well as the airflow paths 412 and 410 through the connector and heater assembly.

The connector 402, in this example a seal sealing the airway tube 308 to the heater assembly 162 whilst allowing airflow therebetween, provides two conduits through which air can pass. The conduits are generally defined by a respective outlet 406 of the heater assembly and the inlet 420 to the airway tube 308. Along the conduit, between the heater assembly and the airway tube, is a neck or narrow portion 422 and 424 which has a reduced cross-section with respect to the outlet 406 of the heater assembly. In this example, the cross-sectional area and the shortest cross-sectional diameter of the neck or narrow portion is smaller than the corresponding area and diameter of the outlets 406.

Airflow through the consumables is indicated by the arrows 410 and 412. Air enters the consumable via inlet 164, and passes through the heater assembly 162. The heater assembly in this example is a coil and wick assembly, and so the air flow passes through the wick material. The airflow bifurcates, and exits the heater assembly through each outlet 406, whereupon at least two airflows enters the connector 402. The conduits in the connector include one or more turns, defined at least in part by a baffle and exterior wall. The airflow passes through the connector, and into the airway tube 308. As discussed in relation to FIG. 3, the airflow then enters the mouthpiece 166 before inhalation.

Figure 5:
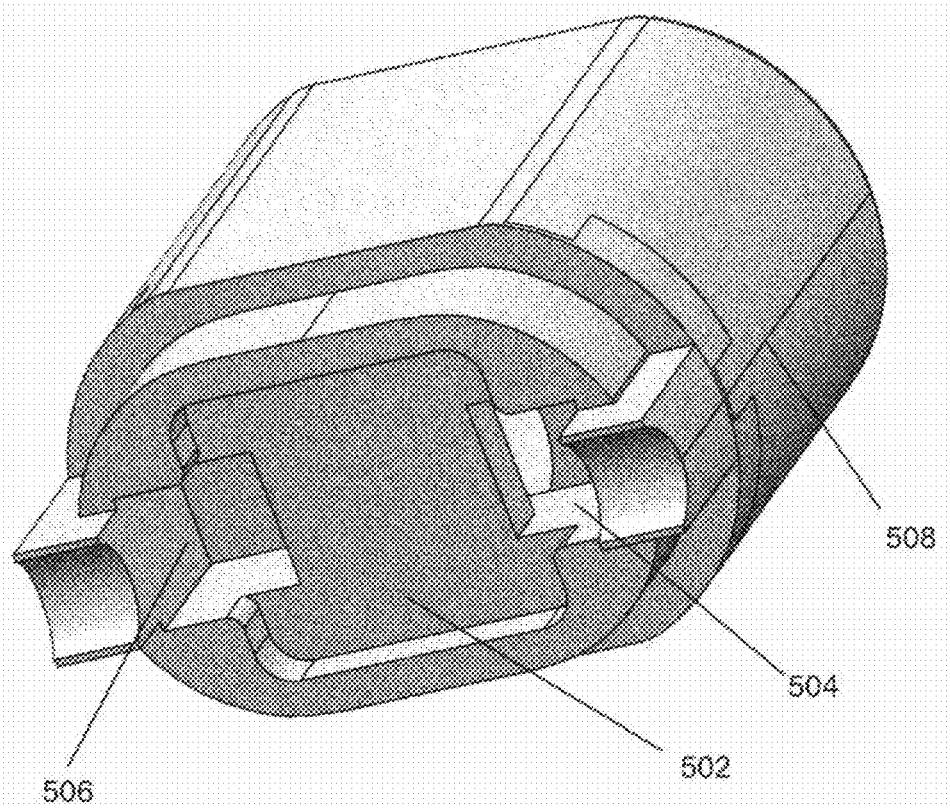
FIG. 5 is a perspective view of a connector.

FIG. 5 shows a perspective view of the connector 402. More clearly seen in this view is the baffle 502, which interrupts the flow of air between the heater assembly and the airway tube. Also shown in this view are first and second connector inlets 504 and 506, which abut and are fluidly connected to the outlets 406 of the heater assembly. An inner wall of outer shell 508 and baffle 502 define the conduits through which air flows. When installed, the airway tube is inserted into an end of the connector which is opposite to the baffle 502 and the heater assembly is connected to the end of the connector opposite to the airway tube.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

LIST OF FEATURES

110 Smoking substitute device
120 Main body
122 Top end of main body
124 Bottom end of main body
126 Light
128 Slot
130 Control unit
132 Memory
134 Wireless interface
136 Electrical interface
138 Additional component
140 Power source
150 Consumable
152 Top end of consumable
154 Bottom end of consumable
156 Tank
158 Window
160 Electrical interface
162 Heating device
164 Air inlets
166 Mouthpiece
168 Additional components
170*a,b* Aperture for clip
302 Filter
304 Tank housing
306 Airway tube
308*a,b* Clip
312 Mouthpiece chamber
314*a,b* Mouthpiece outlets
402 Connector
406 Outlet from heater assembly
410, 412 Airflow path
502 Baffle
504, 506 Inlet to connector
508 Outer shell

The invention claimed is:

1. A consumable for a smoking substitute device, the consumable comprising:

a tank, for storing vapourisable liquid, the tank having a peripheral tank wall;

a heater assembly; and a connector within the tank, the connector having at least two conduits in fluid communication with the heater assembly, each conduit defining a respective airflow paths extending from the heater assembly to an inlet of an airway tube;

wherein each airflow path has a first cross-section, located proximal to the heater assembly, and a second cross-section, located proximal to the airway tube, and wherein the first cross-section is larger than the second cross-section such that each airflow path through the connector narrows in a direction from the heater assembly to the airway tube;

wherein the airway tube is inserted into a first end of the connector and a second end of the connector is sealed against the heater assembly, the second end being opposite to the airway tube; and wherein the connector seals the heater assembly to the airway tube such that the vaporizable liquid stored in the tank cannot seep into the airway tube.

2. The consumable of claim 1, wherein the consumable includes one or more fixed baffles, which at least partially defines the respective airway paths.

3. The consumable of claim 1, wherein each airflow path includes at least two turns.

4. The consumable of claim 1, further comprising a mouthpiece connected to the airway tube at a point distal to the connector.

5. The consumable of claim 4, further comprising a filter, disposed between the tank and an outlet of the mouthpiece, which is configured to be impermeable to unvapourised liquid and permeable to vapourised liquid.

6. The consumable of claim 5, wherein the filter is positioned in or adjacent to the mouthpiece.

7. The consumable of claim 5, further including an air inlet, disposed at an opposite end of the consumable to the mouthpiece, and wherein the air inlet, heater assembly, and mouthpiece define a path for airflow through the consumable in that order.

8. The consumable of claim 5, wherein the filter is formed from a fabric so as to be permeable to vapourised liquid but impermeable to unvapourised liquid.

9. The consumable of claim 5, wherein the filter is formed from a mesh so as to be permeable to vapourised liquid but impermeable to unvapourised liquid.

10. The consumable of claim 5, wherein the filter is a gas-permeable and liquid-impermeable membrane.

11. The consumable of claim 1, wherein the airflow path through the connector is tortuous.

12. The consumable of claim 1, wherein a portion of the airway tube proximal to the heater assembly has a cross-sectional area of more than 5 $mm^2$.

13. The consumable of claim 1, wherein the airway tube has a cross-sectional area of no more than 10 $mm^2$.

14. The consumable of claim 1, wherein the airway tube has an internal diameter of more than 2.5 mm.

15. The consumable of claim 1, wherein an internal diameter of the airway tube is no more than 4 mm.

16. The consumable of claim 1, wherein the airway tube has a cross-sectional area, and wherein the cross-sectional area of the airway tube is substantially constant along its length.

17. The consumable of claim 1, wherein an internal diameter of the airway tube is at least 20% of a width of the tank.

18. The consumable of claim 17, wherein the tank has a width, as measured in the same direction as the internal diameter of the airway tube, of at least 10 mm and no more than 20 mm.

19. A smoking substitute device, comprising the consumable of claim 1.

* * * * *